US007063526B2

(12) United States Patent
Ham et al.

(10) Patent No.: US 7,063,526 B2
(45) Date of Patent: Jun. 20, 2006

(54) REFILLABLE MELODY CANDLE

(76) Inventors: Yoon Ho Ham, 106-Samsung Apt., Pungukcheon-dong, Yongin-si, Kyungi-do (KR); Mun Yong Kim, 1355-10 Gonghang-dong, Kangseo-gu, Seoul (KR)

( * ) Notice: Subject to any disclaimer, the term of this patent is extended or adjusted under 35 U.S.C. 154(b) by 198 days.

(21) Appl. No.: 10/778,671

(22) Filed: Feb. 13, 2004

(65) Prior Publication Data

US 2005/0180148 A1 Aug. 18, 2005

(51) Int. Cl.
*F23Q 2/32* (2006.01)

(52) U.S. Cl. ..... 431/253; 431/289; 431/322

(58) Field of Classification Search ..... 431/253, 431/289, 322, 298, 320, 325; 362/447
See application file for complete search history.

(56) References Cited

U.S. PATENT DOCUMENTS 4,477,249 A * 10/1984 Ruzek et al. ..... 431/253
4,568,269 A * 2/1986 Lin ..... 431/253
4,983,119 A * 1/1991 Lin ..... 431/253
5,807,096 A * 9/1998 Shin et al. ..... 431/253
5,921,767 A * 7/1999 Song ..... 431/253
6,033,209 A * 3/2000 Shin et al. ..... 431/253
6,050,812 A * 4/2000 Chuang ..... 431/253
6,074,199 A * 6/2000 Song ..... 431/253
2002/0119413 A1* 8/2002 Cheng ..... 431/289

* cited by examiner

*Primary Examiner*—Alfred Basichas
(74) *Attorney, Agent, or Firm*—Sheridan Ross P.C.

(57) ABSTRACT

Disclosed is a refillable melody candle in which a seated plate having a sensor and a melody chip built therein is coupled to the bottom of a body of the candle in such a manner as to be removably coupled to a separate base having a power supply section and a driving controller built therein. The melody candle of the present invention has an economical effect in that it enables the re-use of the base in spite of replacement of a candle body. Further, the inventive melody candle may include a number of candle bodies, and the seated plates corresponding to the candle bodies includes melody chips having different melody sounds stored therein, respectively, such that a user can selectively hear various melodies. In addition, the use of the coupling cap for improving the coupling ability between the base and the body simplifies assembly process of the melody candle.

5 Claims, 7 Drawing Sheets

REFILLABLE MELODY CANDLE

BACKGROUND OF THE INVENTION

1. Field of the Invention

The present invention relates to a refillable melody candle, and more particularly, to a refillable melody candle in which a seated plate having a sensor and a melody chip built therein is coupled to the bottom of a body of the candle in such a manner as to be removably coupled to a separate base having a power supply section and a driving controller built therein.

2. Background of the Related Art

In general, a melody candle includes a body 10 formed into a solid state by solidifying a combustible material, and a wick 11 interposed in the center of the body and made in such a manner that natural fibers or chemical fibers are processed in the form of threads or fabrics and then twisted in the form of spiral knitting yarn.

An optical transmission member 13 for transmitting light of a flame 12 generated during the combustion of the wick is interposed inside of the wick 11. The optical transmission member 12 is configured with an optical fiber used as a transmission line for optical communication.

The melody candle also includes a base portion 20 having a seated plate 20*a* formed at the top thereof for seating and fixing the bottom portion of the body 10, a volume adjust button 21 mounted at one side thereof for gradually adjusting volume level of the melody candle, and a battery container formed at a predetermined position therein for receiving batteries 22.

A printed circuit board (PCB) 24, which has a melody storage chip 26 for storing various melodies classified by genre, an optical sensor 25 as on/off means for playing back sounds stored in the melody storage chip 26, etc., mounted thereon, is installed within the base portion 20. At this time, the optical sensor 25 is positioned to be oriented vertically toward the lower end portion of the optical transmission member 13 interposed inside of the wick so as to receive light emitted from the optical transmission member.

A flame intercepting member 14 made of a metal material is disposed at the lower portion of the wick 11 so as to prevent the wick from being burnt.

When the tip of the wick 11 of the melody candle A constructed as above catches fire, it becomes ignited while generating flame. At this time, light emitted by the flame is downwardly transmitted to the optical sensor 25 positioned vertically via the optical transmission member 13 interposed inside of the wick such that the optical sensor 25 may receive the light.

Thereafter, the light sensor detects the received light and supplies power from batteries to the melody storage chip 26. Then, the melody storage chip outputs various melody sounds stored therein so as to play back them through a loudspeaker 23.

However, for the above conventional melody candle, there has been a problem in that since the body of the candle and the base portion for generating melodies are integrally formed with each other, it is difficult for general users to replace a burnt-out candle used with a new one.

To this end, there has been developed a technology which enables replacement of a candle used with a new one. As shown in FIG. 2, two different twisted metal wires are jointed together such as thermocouple so as to sense flame of a candle. Electromotive force effect generated between the two metal conductors when heat is applied to the junctions of the metal wires, is used as Seeback effect. The conductors are configured in such a manner as to be thin enough to be burnt by flame of the candle, and hence can be burnt together with the candle wick 6. In order to transmit electromotive force generated from the candle wick 6 during the burning of the candle to the a sound playback device, a metal wire 1 and a metal wire 2 used as conductors in FIG. 2 is soldered to a circuit board 3 having two concentric circular electrodes 4 and 5, respectively. This structure is made in such a manner that the two electrodes 4 and 5 mounted on the bottom surface of the candle are in contact with the sound playback device disposed within a separate support.

However, since such a conventional technology employs Seeback back, each of the metal wires is not molten well during the heating of it, such that it may be exposed to the outside of the candle. In addition, long term use of the metal wires contributes to soot production, which in turn deteriorates quality of the candle. Further, since this prior art is only a method in which a burnt-out candle is replaced with a new one, a melodies stored in the sound playback device are always outputted in a uniform pattern, which may allow a user to feel a repugnance to the candle in use during a for long time.

SUMMARY OF THE INVENTION

Therefore, the present invention has been made in view of the above problems, and it is an object of the present invention to provide a melody candle in which a seated plate has a melody chip for generating a unique melody sound built therein and is coupled to the bottom of a candle body in such a manner as to be removably coupled to a separate base, such that when the candle is ignited it outputs its own unique melody sound from the melody chip.

Another object of the present invention is to provide a melody candle in which different melody sounds are stored in melody chips built in the seated plates of respective candles, to thereby satisfy various desires of users according to season, weather, sex and taste.

Another object of the present invention is to provide a melody candle in which a fitting recess is formed on the central bottom portion of a candle body such that a coupling cap is pressedly fitted into the fitting recess while being coupled with a coupling part formed on a seated plate, to thereby facilitate both the coupling between a candle body and the seated plate and the fixing of a candle wick.

To accomplish the above objects, according to the present invention, there is provided a refillable melody candle comprising: a body; a seated plate including a coupling part protruded from a central upper surface thereof so as to fix a wick which is interposed inside of the body and has an optical transmission member built therein at the bottom surface of the body, an optical sensor disposed at a corresponding portion of the lower end of the optical transmission member, a melody chip coupled to the optical sensor, the optical sensor and the melody chip being received in the seated plate, power terminals mounted on the underside thereof such that they can be interlocked with the optical sensor upon the actuation of the optical sensor, an output terminal of the melody chip; and a base including a receiving recess formed on the upper surface thereof for receiving the seated plated and the bottom portion of the body therein, base terminals mounted on the bottom surface of the receiving recess to be electrically conducted with the power and output terminals, respectively, a controller and a power supply section disposed inside thereof for outputting a predetermined melody via the respective base terminals, whereby a melody is generated from the base coupled to the bottom portion of the candle when the optical sensor senses flame of the candle via the optical transmission member.

According to the present invention, the seated plate having the optical sensor and the melody chip is coupled to the bottom surface of the candle body, the candle including the seated plate is removably received within the receiving recess of the base, the base amplifies a melody sound to output it to the outside via the seated plate, and the base terminals are protruded from the top surface of the receiving recess to enable electrical connection of the base terminals to the output terminal of the seated plate upon the contacting between the base terminals and the output terminal of the seated plate. Further, the coupling part is formed protrudedly on the central top surface of the seated plate such that the seated plate can be easily coupled to the bottom surface of the candle body with the coupling part being fitted into the coupling cap.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now made in detail to the preferred embodiment of the present invention with reference to the attached drawings.

Figure 1:
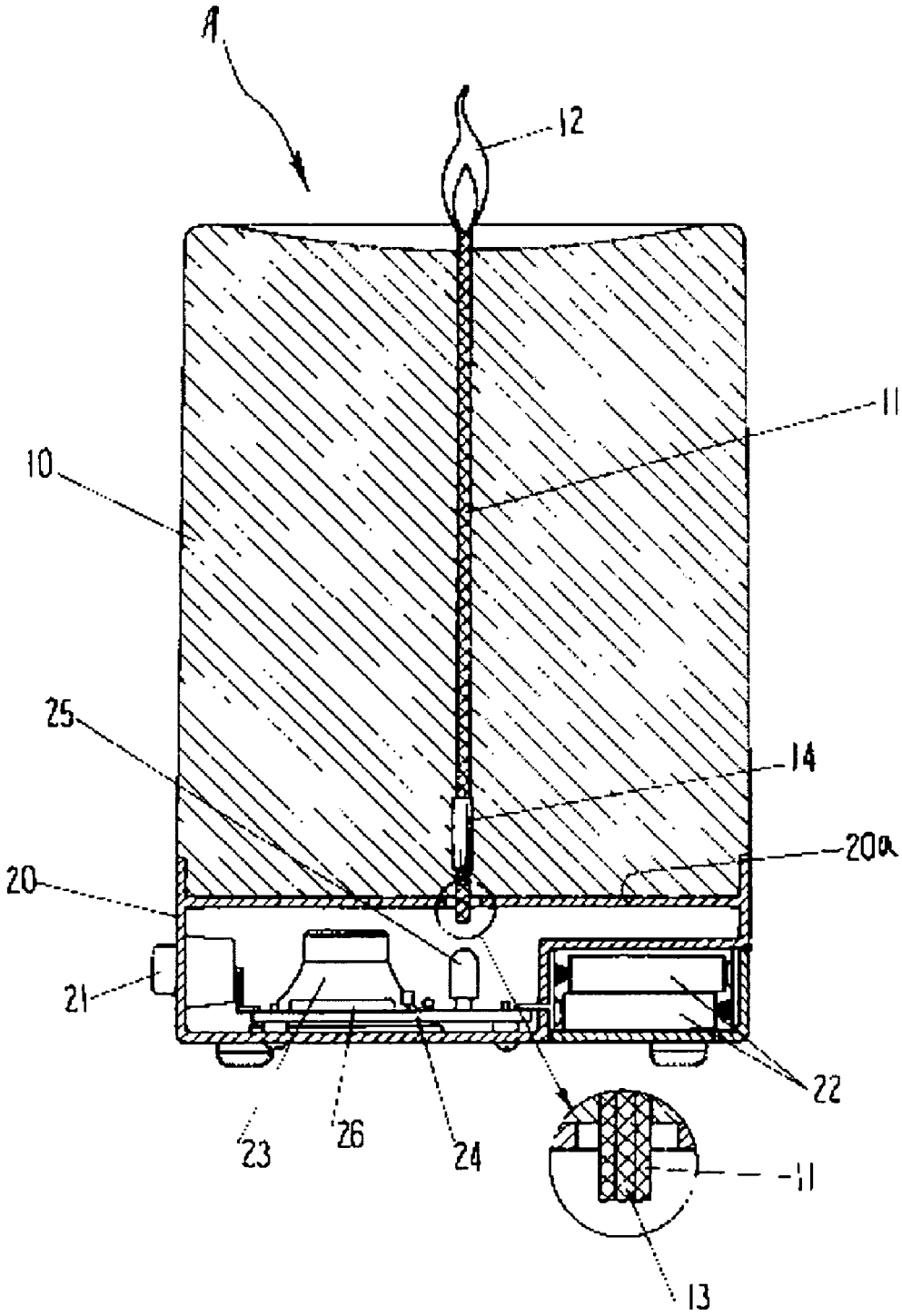
Fig. 1 (Prior Art)
FIG. 1 is a longitudinal sectional view illustrating a general melody candle.
Figure 2:
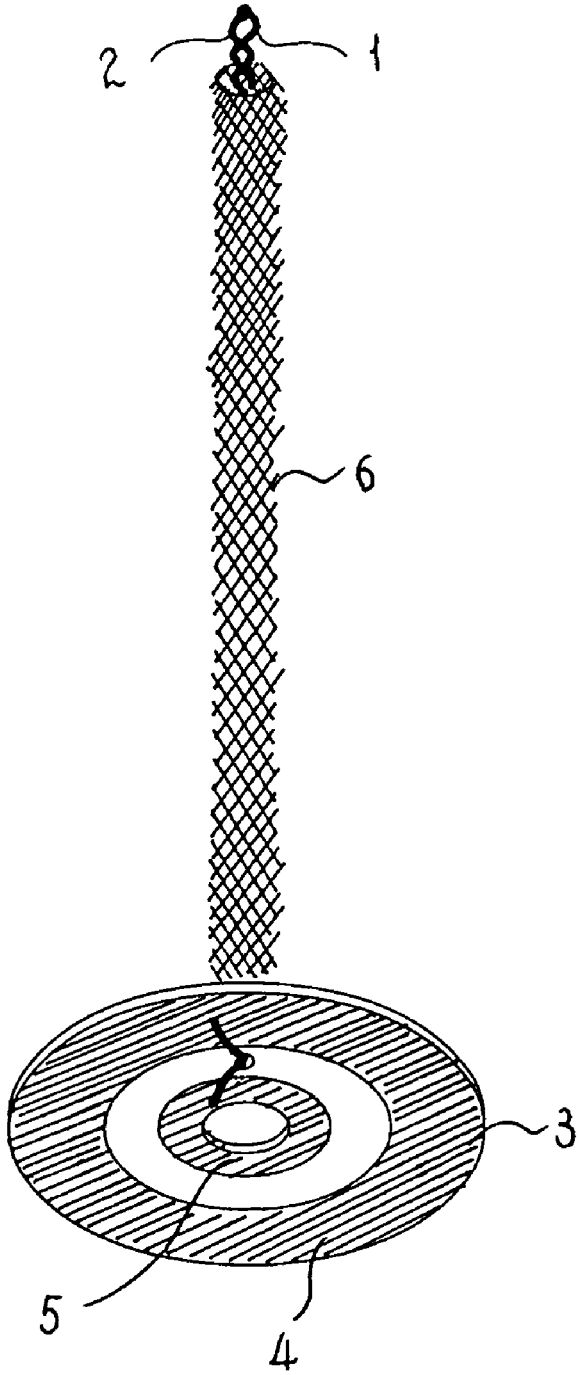
Fig. 2 (Prior Art)
FIG. 2 is a schematic perspective view illustrating essential parts of another example of a general melody candle.
Figure 3:
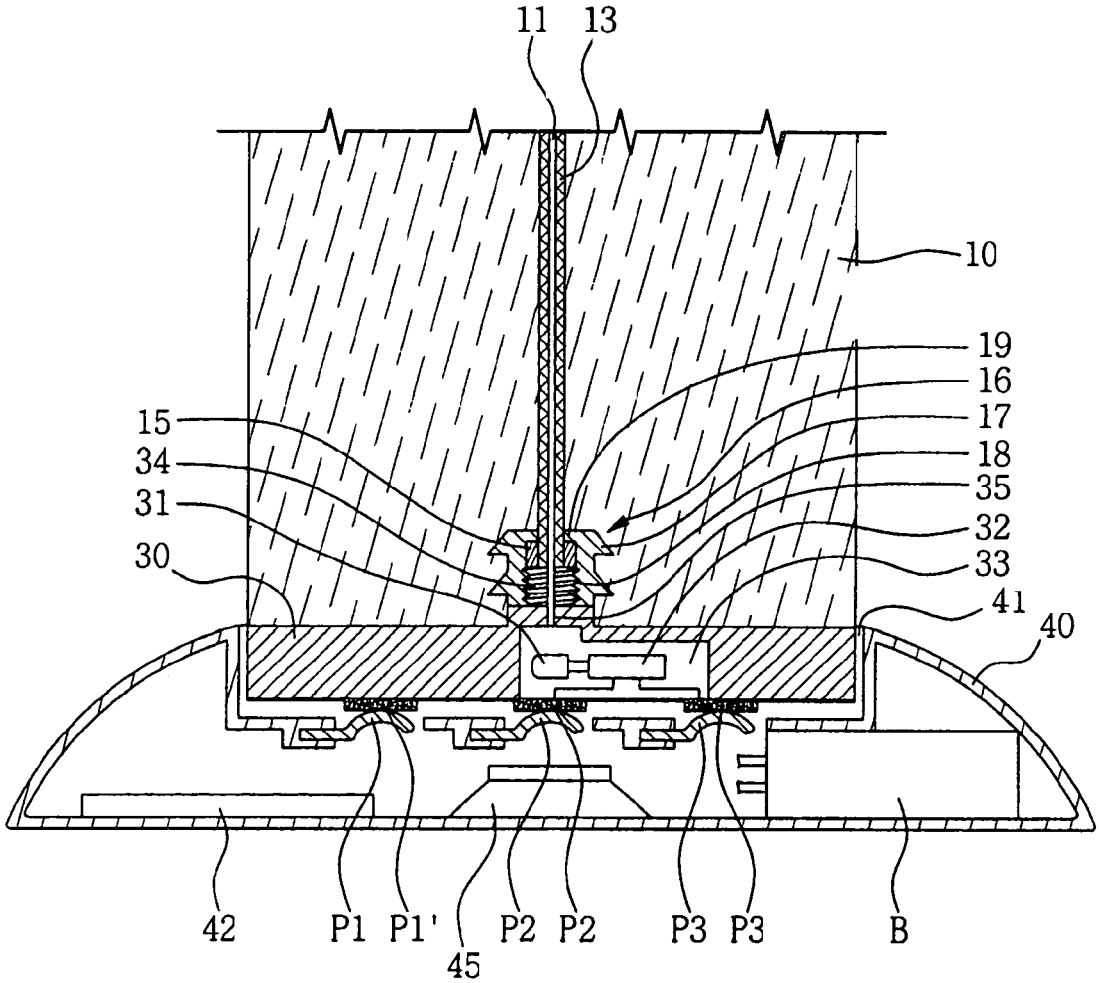
FIG. 3 is a longitudinal sectional view illustrating a refillable melody candle according to the present invention.

FIG. 3 is a longitudinal sectional view illustrating a refillable melody candle according to the present invention.

Referring to FIG. 3, there is shown a refillable melody candle including a body 10, a seated plated 30 and a base 40.

The seated plate 30 includes a coupling part 34 protruded from a central upper surface thereof so as to fix a wick 11 which is interposed inside of the body 10 and has an optical transmission member 13 built therein at the bottom surface of the body, an optical sensor 31 disposed at a corresponding portion of the lower end of the optical transmission member 13, a melody chip 32 coupled to the optical sensor 31, the optical sensor and the melody chip being received in the seated plate, power terminals P1' and P2' mounted on the underside thereof such that they can be interlocked with the optical sensor 31 upon the actuation of the optical sensor 31, an output terminal P3' of the melody chip 32.

The base 40 includes a receiving recess 41 formed on the upper surface thereof for receiving the seated plated 30 and the bottom portion of the body 10 therein, base terminals P1, P2 and P3 mounted on the bottom surface of the receiving recess 41 to be electrically conducted with the power and output terminals P1' P2' and P3', respectively, a controller 42 and a power supply section B disposed inside thereof for outputting a predetermined melody via the respective base terminals P1, P2 and P3.

The melody candle further includes a coupling cap 16 having a fixing hole 18 formed therein to be coupled with the outer circumferential surface of the coupling part 34 and having a hook protrusion 17 formed on the outer circumferential surface thereof to be fixedly fitted into a fitting recess formed at the central bottom surface of the body 10. The coupling cap 16 also serves to internally cap a pressed fixing member 15 mounted at the lower end portion of the wick 11 for pressedly fixing the wick together with the coupling part 34.

Figure 4:
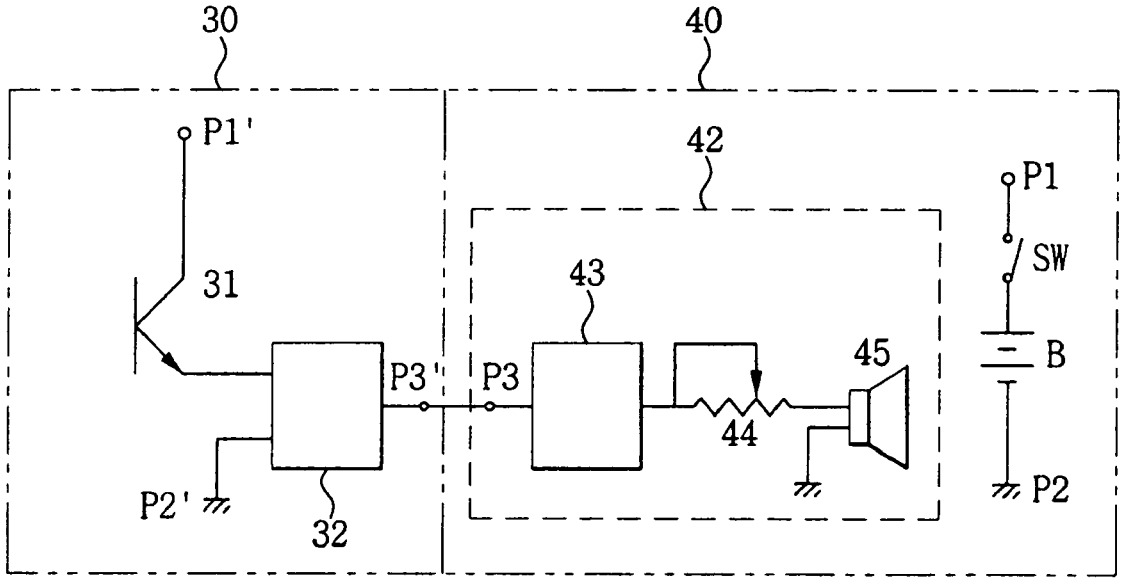
FIG. 4 is a circuit diagram illustrating the construction of the refillable melody candle according to the present invention.

FIG. 4 is a circuit diagram illustrating the construction of the refillable melody candle according to the present invention.

Referring to FIG. 4, the terminals P1', P2 and P3' of the seated plate 30 and the terminals P1, P2 and P3 of the base 40 are correspondingly coupled to one another in such a manner as to be in contact with one another. The seated plate 30 includes an optical sensor 31 such as a photo coupler for sensing light via the optical transmission member, i.e., an optical fiber of FIG. 3, and a melody chip 32 for being supplied with power through the power terminal P1' upon the actuation of the optical sensor 31 and applying the supplied power to the output terminal P3'.

The base 40 includes a controller 42 which has an amplifier 43 for receiving the output sound from the melody chip 32 via an input terminal P3 connected to the output terminal P3' of the seated plate 30 and amplifying the output sound to output it, a variable resistor 44 for variably adjusting the amplified sound from the amplifier 43 to output it, and a speaker 45 for outputting the adjusted sound from the variable resistor 44 as a audible signal to the outside. Of course, the power supply section B such as a battery contained in the base 40 is used as a needed power source, but an adapter for rectifying AC power into DC power may be used, if necessary. Although there has been described the sensing of flame of the candle via the optical fiber 13 and the optical sensor 31 herein, the sensing of flame may be implemented by other sensing methods (known equivalent means such as Seeback, glass fiber, thermal conduction, etc.).

Figure 5:
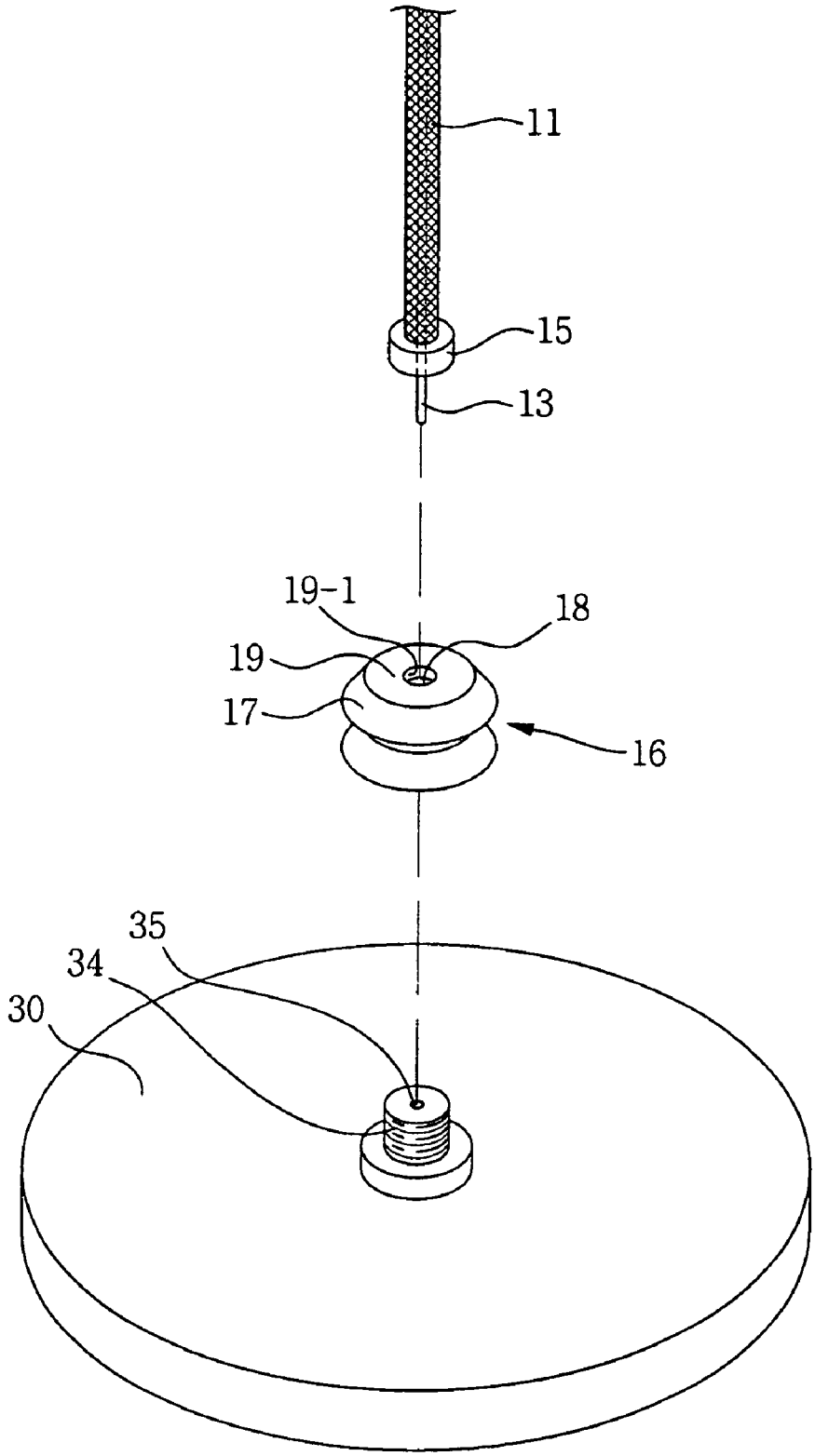
FIG. 5 is an exploded perspective view illustrating essential parts of the refillable melody candle according to the present invention.

FIG. 5 is an exploded perspective view illustrating essential parts of the refillable melody candle according to the present invention.

Referring to FIG. 5, a coupling part 34 is protruded from a central upper surface of the seated plate 30 such that a wick 11 and an optical transmission member 13 are placed on the coupling part. A coupling cap 16 has a fixing hole 18 formed therein for internally capping, a pressed fixing member 15 mounted at the lower end portion of the wick to pressedly fix the wick, together with the coupling part 34, such that it may be fitted around the outer circumferential surface of the coupling part 34. A hook protrusion 17 is formed on the outer circumferential surface of the coupling cap 16 to be fixedly fitted into a fitting recess 10-1 formed at the central bottom surface of the candle body 10. The coupling part 34 also has an optical fiber inserting hole 35 for inserting the optical transmission member 13 thereto so as to guide the optical transmission member 13 toward the optical sensor 31.

Figure 6:
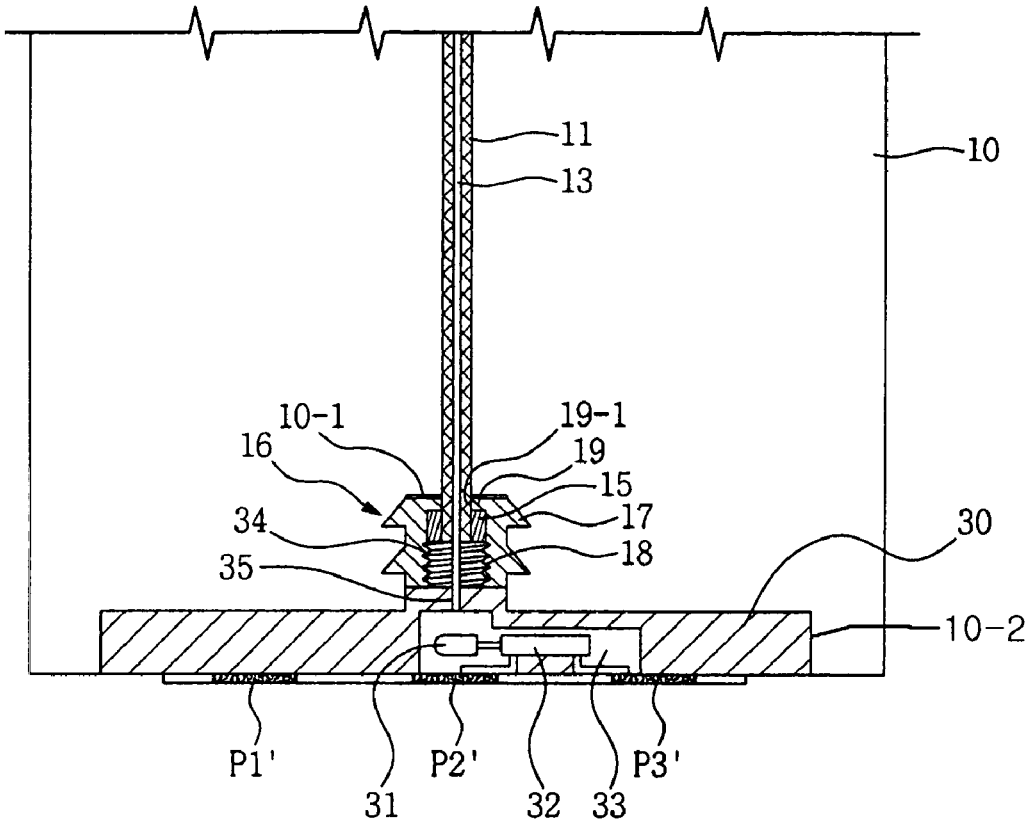
FIG. 6 is a longitudinal sectional view illustrating an assembled state of essential parts of the refillable melody candle according to the present invention.

FIG. 6 is a longitudinal sectional view illustrating an example of an assembled state of essential parts of the refillable melody candle according to the present invention.

Referring to FIG. 6, the candle body 10 has a recess 10-2 formed on the bottom surface thereof for receiving the seated plate 30 therein in such a manner that the bottom surface of the body is flush with the bottom surface of the seated plate 30. The coupling cap 16 is so structured that it is slidably fitted into the fitting recess 10-1 formed at the central bottom surface of the body. The top end portion of the fixing hole 18 defining the inner diameter of the coupling cap 16 forms a pressing plate 19 having a pressing hole 19-1 formed therein. The diameter of the pressing hole 19-1 is smaller than that of the fixing hole 18 so that the wick 11 and the optical transmission member 13 are tightly inserted into the pressing hole to be received within the coupling cap 16.

Figure 7:
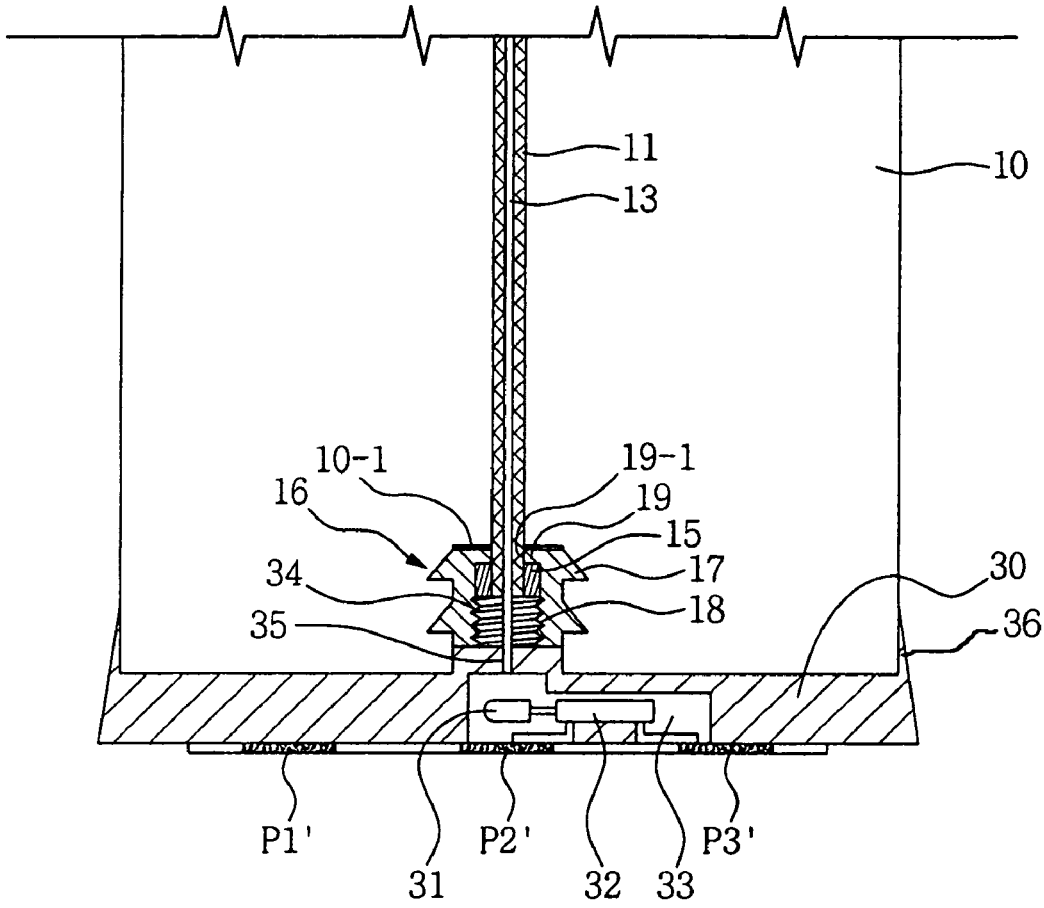
FIG. 7 is a longitudinal sectional view illustrating another assembled state of essential parts of the refillable melody candle according to the present invention.

FIG. 7 is a longitudinal sectional view illustrating another example of the assembled state of essential parts of the refillable melody candle according to the present invention.

As shown in the drawing, the construction of FIG. 7 is identical to that of FIG. 6 except that the body 10 does not have the recess 10-2 of FIG. 6 formed on the bottom surface thereof, and different from that of FIG. 6 in that the seated plate 30 has a peripheral dam 36 formed at the outer circumference thereof in such a manner as to be extended slantingly upward from the outer circumferential surface thereof so as to correspondingly encircle a bottom peripheral portion of the body 10.

According to the present invention constructed as above, the actuation of a switch SW applies power supplied from the power supply section B such as a battery, etc., to the seated plate 30 via the base 40. At this time, when a user lights the tip of the wick 11, the optical sensor 31 of FIGS. 3, 4, 6 and 7 is operated via the optical transmission member 13 such as an optical fiber. When the optical sensor 31 is operated, a bias voltage from the power supply section B is applied to the seated plate 30 such that battery power of the power terminal P1' drives the melody chip 32 via a collector terminal of the optical sensor 31 which is called a photo coupler. The melody sound outputted from the melody chip 32 is supplied to the input terminal P3 of the amplifier 43 which in turn amplifies the melody sound to a corresponding sound level to output the amplified sound to the outside through the speaker 45. Of course, the volume of the sound may be adjusted by the variable resistor 44, if necessary.

When the candle is burnt out after a lapse of the certain time period, a remaining portion of the candle body 10 coupled with the seated plate 30 is replaced with a new separate candle set coupled with a seated plate such that a user can hear another new melody sound. To this end, as shown in FIG. 5, the pressed fixing member 15 presses and fixes the lower end portion of the wick 11 having the optical transmission member 13, after which a part of the optical transmission member 13 extended downwardly from the bottom surface of the pressed fixing member 15 alone or/and the wick 111 is/are tightly inserted into the optical fiber inserting hole 35 of the coupling part 34. In this case, there is of course used the seated plate 30 having the optical sensor 31 and the melody chip 32 built therein as shown in FIGS. 3, 6 and 7. Then, the lower end portion of the optical transmission member 13 is disposed opposite to the optical sensor 31. The coupling cap 16 is moved downwardly from the upper end portion of the wick 11 to the lower end portion thereof along a longitudinal direction of the wick in such a manner as to fit around the wick through the fixing hole 18 thereof, so that it can press the coupling part 34 to encircle the pressed coupling part therein or can be threadedly coupled with the coupling part 34. At this time, the fixing hole 18 of the coupling cap 16 preferably has threads formed on the inner circumferential surface thereof to enable the coupling part 34 to be engaged with the coupling cap 16 or has protrusions formed on the inner circumferential surface thereof to enable the coupling part 34 to be pressedly fitted into the coupling cap 16. Then, the pressing plate 19 formed on the top end of the fixing hole 18 presses against the bottom surface of the pressed fixing member 15 to securely fix the wick 11. Thereafter, the coupling cap 16 previously coupled with the coupling part 34 is pressedly fitted into the fitting recess 10-1 as shown in FIGS. 6 and 7. Although the fitting of the coupling cap 16 into the fitting recess 10-1 has been easily and simply performed by the pressing action of the hook protrusion 17 of the coupling cap 16, the seated plate 30 is prevented from being separated from the body 10 to thereby ensure stability in use. In addition, only the simple fitting action enables an assembly between the seated plate 30 and the candle body 10 to thereby shorten the assembly time for the candle. Further, like in FIG. 6, the seated plate 30 is adapted to be received within the bottom recess 10-2 of the body 10 upon the coupling between the seated plate 30 and the body 10. Accordingly, the assembly structure as mentioned above can be used for a candle having a large diameter body. On the other hand, for a candle having a small or regular diameter body, a peripheral dam 36 is formed at the outer circumference of the seated plate 30 to correspondingly encircle and protect a bottom peripheral portion of the body 10 so as to improve durability of or prevent deformation of the bottom structure of the body.

As described above, a seated plate having a sensor and a melody chip built therein is coupled to the bottom of a body of the candle in such a manner as to be coupled/released to/from a receiving recess of a separate base. Accordingly, the base is kept as it is, and the candle body coupled with the seated plate is replaced with a new separate candle set coupled with a seated plate to thereby enable the refill of a candle which has been burnt out.

In addition, the melody candle of the present invention employs a technology in which the seated plate has a melody chip built therein, and hence different melody sounds are generated according to respective candles, to thereby satisfy various desires of users according to season, weather, sex and taste, which contributes to an increase in sale of candle products.

Further, a protrusion, i.e., a coupling cap is formed on the central top surface of the seated plate to fix a wick of the candle, and has a hook protrusion formed on the outer circumferential surface thereof to be easily fitted into a fitting recess formed at the central bottom surface of the candle body without a separate coupling tool.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A refillable melody candle comprising:

a body;

a seated plate including a coupling part protruded from a central upper surface thereof so as to fix a wick which is interposed inside of the body and has an optical transmission member built therein at the bottom surface of the body, an optical sensor disposed at a corresponding portion of the lower end of the optical transmission member, a melody chip coupled to the optical sensor, the optical sensor and the melody chip being received in the seated plate, power terminals mounted on the underside thereof such that they can be interlocked with the optical sensor upon the actuation of the optical sensor, an output terminal of the melody chip; and a base including a receiving recess formed on the upper surface thereof for receiving the seated plated and the bottom portion of the body therein, base terminals mounted on the bottom surface of the receiving recess to be electrically conducted with the power and output terminals, respectively, a controller and a power supply section disposed inside thereof for outputting a predetermined melody via the respective base terminals, whereby a melody is generated from the base coupled to the bottom portion of the candle when the optical sensor senses flame of the candle via the optical transmission; and, comprising a coupling cap having a fixing hole formed therein to be coupled with the outer circumferential surface of the coupling part and having a hook protrusion formed on the outer circumferential surface thereof to be fixedly fitted into a fitting recess formed at the central bottom surface of the body, the coupling cap serving to internally cap a pressed fixing member mounted at the lower end portion of the wick for pressedly fixing the wick together with the coupling part.

2. The refillable melody candle according to claim 1, wherein the controller has an amplifier for receiving the output sound from the melody chip via the base terminal and amplifying the sound to output it, a variable resistor for variably adjusting the amplified sound outputted from the amplifier to output it, and a speaker for outputting the adjusted sound from the variable resistor as a audible signal to the outside.

3. The refillable melody candle according to claim 1, wherein the body has a recess formed on the bottom surface thereof for receiving the seated plate therein in such a manner that the bottom surface of the body is flush with the bottom surface of the seated plate.

4. The refillable melody candle according to claim 1, wherein the seated plate has a peripheral dam formed at the outer circumference thereof in such a manner as to be extended slantingly upward from the outer circumferential surface thereof so as to correspondingly encircle a bottom peripheral portion of the body.

5. The refillable melody candle according to claim 1, wherein the top end portion of the fixing hole defining the inner diameter of the coupling cap forms a pressing plate having a pressing hole formed therein, the diameter of which is smaller than that of the fixing hole so that the wick and the optical transmission member are tightly inserted into the pressing hole to be received within the coupling cap.

* * * * *